US008985383B2

(12) United States Patent
Campbell et al.

(10) Patent No.: US 8,985,383 B2
(45) Date of Patent: Mar. 24, 2015

(54) PLASTIC CONTAINER AND LID

(71) Applicant: KW Plastics of Troy, Troy, AL (US)

(72) Inventors: N Kenneth Campbell, Troy, AL (US); Darren Scholl, Troy, AL (US); Keith Rukvina, Troy, AL (US)

(73) Assignee: KW Container, Troy, AL (US)

( * ) Notice: Subject to any disclaimer, the term of this patent is extended or adjusted under 35 U.S.C. 154(b) by 122 days.

(21) Appl. No.: 13/918,391

(22) Filed: Jun. 14, 2013

(65) Prior Publication Data

US 2013/0341342 A1 Dec. 26, 2013

Related U.S. Application Data

(63) Continuation of application No. PCT/US2013/044318, filed on Jun. 5, 2013.

(60) Provisional application No. 61/663,440, filed on Jun. 22, 2012.

(51) Int. Cl.
*B65D 45/00* (2006.01)
*B65D 43/02* (2006.01)

(52) U.S. Cl.
CPC ..... *B65D 45/00* (2013.01); *B65D 43/0206* (2013.01); *B65D 2543/00092* (2013.01); *B65D 2543/00462* (2013.01); *B65D 2543/00629* (2013.01); *B65D 2543/00685* (2013.01); *B65D 2543/0074* (2013.01); *B65D 2543/00796* (2013.01); *B65D 2543/0099* (2013.01)
USPC ..... 220/780; 220/254.7; 220/284; 220/783; 206/508; 206/509

(58) Field of Classification Search
CPC ..... B65D 45/00; B65D 43/0206
USPC ..... 220/254.7, 284, 780, 783; 206/508, 509
See application file for complete search history.

(56) References Cited

U.S. PATENT DOCUMENTS

| | | | | |
|---|---|---|---|---|
| 3,977,563 | A | 8/1976 | Holt | |
| 4,397,404 | A * | 8/1983 | Blanchette | 220/783 |
| 4,458,825 | A | 7/1984 | Holota | |
| 4,524,882 | A | 6/1985 | Buc | |
| 5,097,977 | A | 3/1992 | Straub | |
| 6,491,185 | B1 | 12/2002 | Azzarello et al. | |
| 6,588,618 | B1 | 7/2003 | Davis | |

(Continued)

FOREIGN PATENT DOCUMENTS

| | | |
|---|---|---|
| EP | 1487711 | 6/2007 |
| EP | 1967461 | 11/2010 |

(Continued)

OTHER PUBLICATIONS

Choi Hyun Goo "Notification of Transmittal of the International Search Report and The Written Opinion of the International Searching Authority" Application No. PCT/US2013/044318; Aug. 24, 2013; pp. 1-11

*Primary Examiner* — Elizabeth Volz
(74) *Attorney, Agent, or Firm* — Joseph S. Bird, III; Bradley Arant Boult Cummings LLP

(57) ABSTRACT

A plastic container with a rim and a lid, the rim and lid each having channels which, upon installation, produce a liquid-tight fit by means of three complementary pairs of projections from the walls of the channels.

18 Claims, 6 Drawing Sheets

(56) References Cited

U.S. PATENT DOCUMENTS

| | | | |
|---|---|---|---|
| 6,964,348 | B2 | 11/2005 | Breimon et al. |
| 7,703,621 | B2 | 4/2010 | Evans et al. |
| 7,896,185 | B2 | 3/2011 | Campbell et al. |
| 7,988,002 | B2 | 8/2011 | Denner et al. |
| 2006/0043095 | A1 | 3/2006 | Maholm et al. |
| 2009/0014456 | A1 | 1/2009 | Woinarski |
| 2009/0134160 | A1 | 5/2009 | Alvares et al. |
| 2010/0176141 | A1 | 7/2010 | Evans |
| 2011/0036843 | A1 | 2/2011 | Letica et al. |
| 2011/0220671 | A1 | 9/2011 | Evans et al. |

FOREIGN PATENT DOCUMENTS

| | | |
|---|---|---|
| JP | 09-077120 | 3/1997 |
| JP | 10-59391 | 3/1998 |

* cited by examiner

PLASTIC CONTAINER AND LID

STATEMENT REGARDING PRIORITY

This application is a continuation of international application number PCT/US13/44318, filed on Jun. 5, 2013 (currently pending). International application number PCT/US13/44318 claims the benefit of the filing date of U.S. provisional patent application No. 61/663,440, filed on Jun. 22, 2012 (currently pending). International application number PCT/US13/44318 and U.S. provisional patent application No. 61/663440 are incorporated herein by reference in their entireties.

FIELD OF THE INVENTION

The field of the invention is plastic containers and lids including plastic paint cans.

One embodiment of the present invention comprises a plastic container and lid further comprising three seal/latch combinations which provide a liquid-tight seal for packaging liquids including, without limitation, paint. As used herein, a latch is an impediment preventing adjoining surfaces from moving in at least one direction, and a seal is contact between adjoining surfaces.

One embodiment of the invention comprises a container, in a preferred embodiment being a cylinder, comprising a bottom or closed end, a top or open end with a rim, and a lid. In cross-section, the container and lid may also have other forms including, without limitation, a square or rectangle.

The container, rim and lid may be formed by any injection molded, plastic material including, without limitation, polypropylene or polyethylene. The rim may be formed separately from, but secured to, the open end of the container. The rim receives a removable and resealable plastic lid.

As used herein, a structure termed "inner" or "innermost" or the like means that it is closer to the center of the container or lid than a corresponding "outer" or "outermost" structure.

The rim at its inner border comprises an outer channel, and the lid at its peripheral border comprises an inner channel. In one embodiment, the channels are generally U-shaped and comprise walls which are substantially vertical, there being two interior walls and also one exterior wall, and each of these three walls further comprises a projection extending therefrom. The projections from the three walls of the inner channel and from the three walls of the outer channel may be varied in their configurations so long as a projection from the inner channel slides past and is engaged by a complementary projection from the outer channel—and so long as each such complementary pair of projections thereby creates a seal/latch combination. The inner channel defines a first interior space between its two interior walls. The outer channel also defines a second interior space between its two interior walls.

The lid may be secured to the rim by pressing the lid into the rim by ordinary force from pushing by hand. The lid may be removed by placing, for instance, a straight edge underneath the outer edge of the lid and prying upward. In normal usage this way, the lid may be secured and released a large number of times without damaging the seal/latch combinations.

Various other features, objects and advantages of embodiments of the invention will be made apparent from the following description taken together with the drawings.

DETAILED DESCRIPTION

Figure 1:
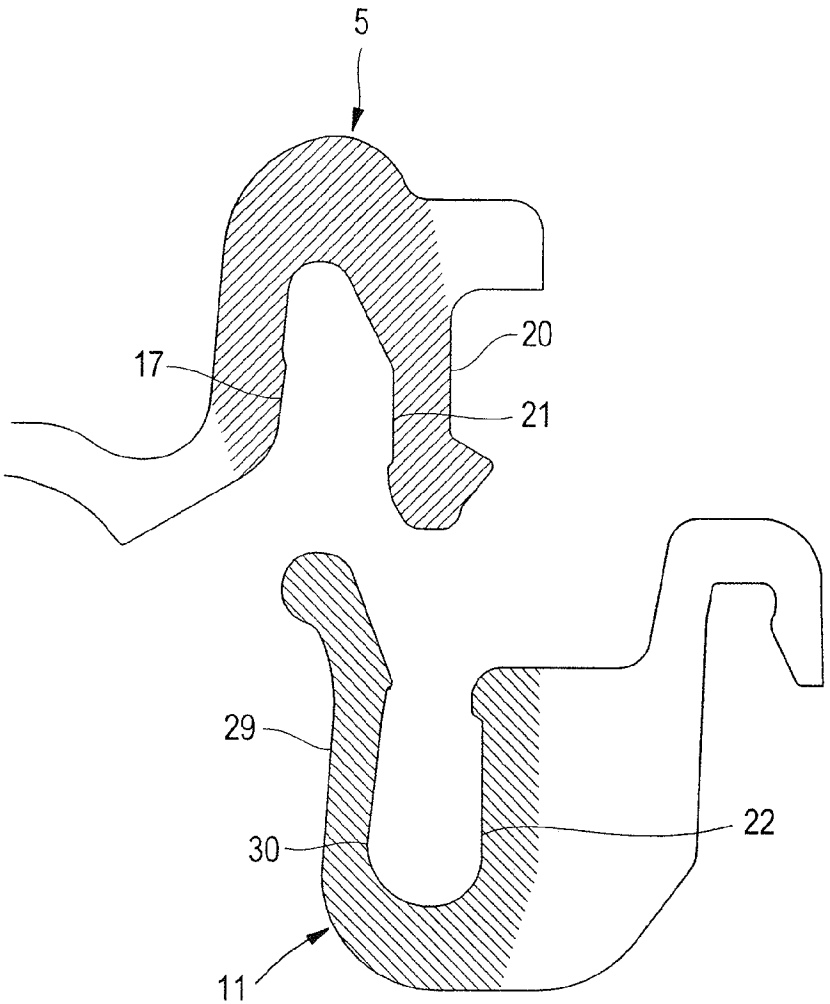
FIG. 1 is a sectional view of the rim and a portion of the lid in one embodiment showing the outer channel and the inner channel.

Referring now to FIG. 1, in cross-section, as shown by diagonal lines, the inner channel 5 is shown on a portion of the lid land the outer channel 11 on the rim 2. In one embodiment, the inner channel 5 is generally U-shaped and has walls which are substantially vertical in orientation when the lid is inserted into the rim, said construction creating a space which faces downward toward the bottom of the container, and comprises a first interior wall 17 and a second interior wall 21 and also one exterior wall 20. Each of these three walls 17, 21, 20 comprises a projection extending therefrom, as detailed below. In one embodiment, the outer channel 11, as shown by diagonal lines, is also generally U-shaped and has walls which are substantially vertical in orientation when the container is upright, creating a space which opens in the same direction as does the top or open end of the container, and comprises a first interior wall 22 and a second interior wall 30 and also one exterior wall 29. Each of these three walls 22, 30, 29 comprises a projection extending therefrom, also as detailed below.

Figure 2:
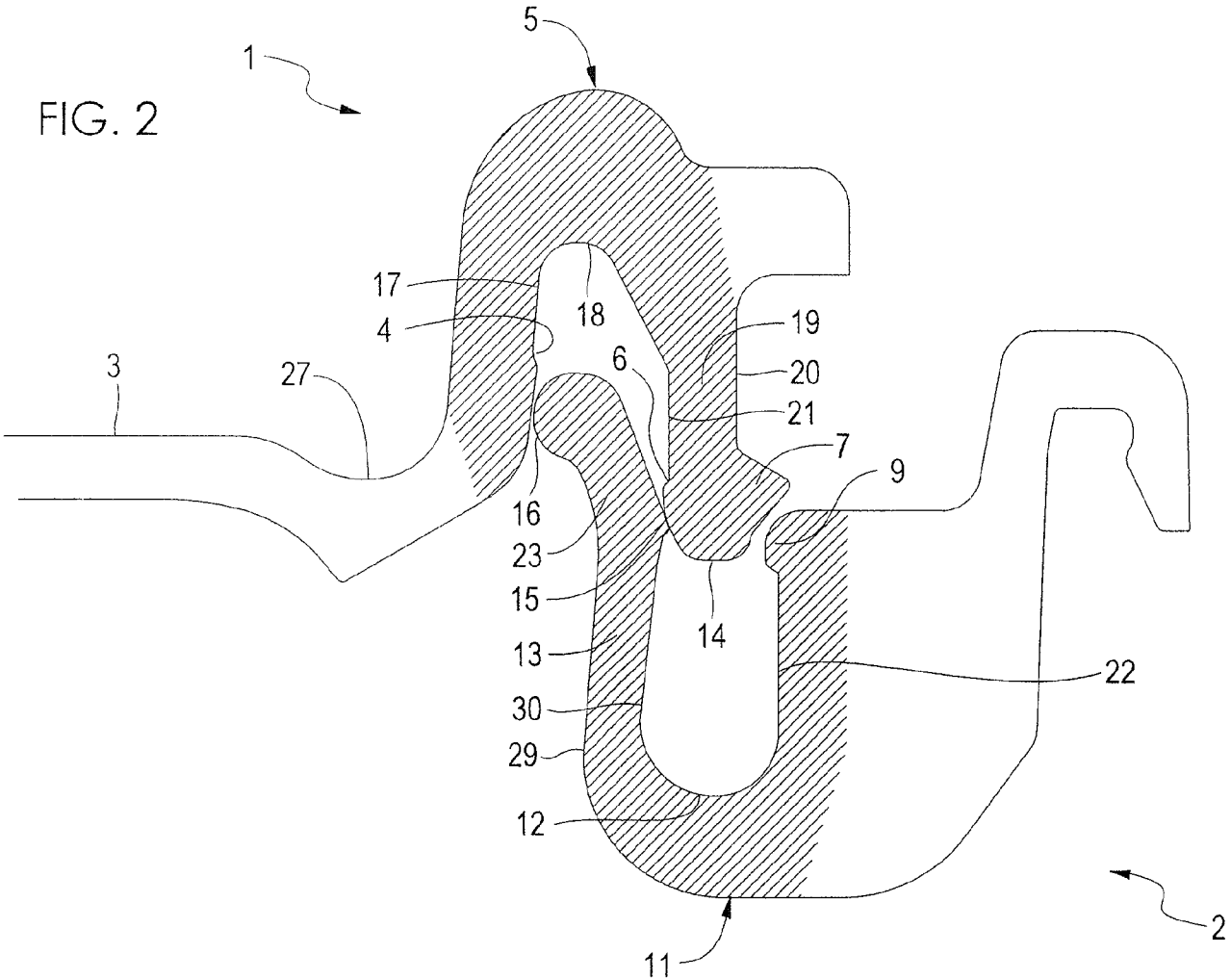
FIG. 2 is a sectional view of the rim and a portion of the lid in one embodiment in the pre-installed position.
Figure 4:
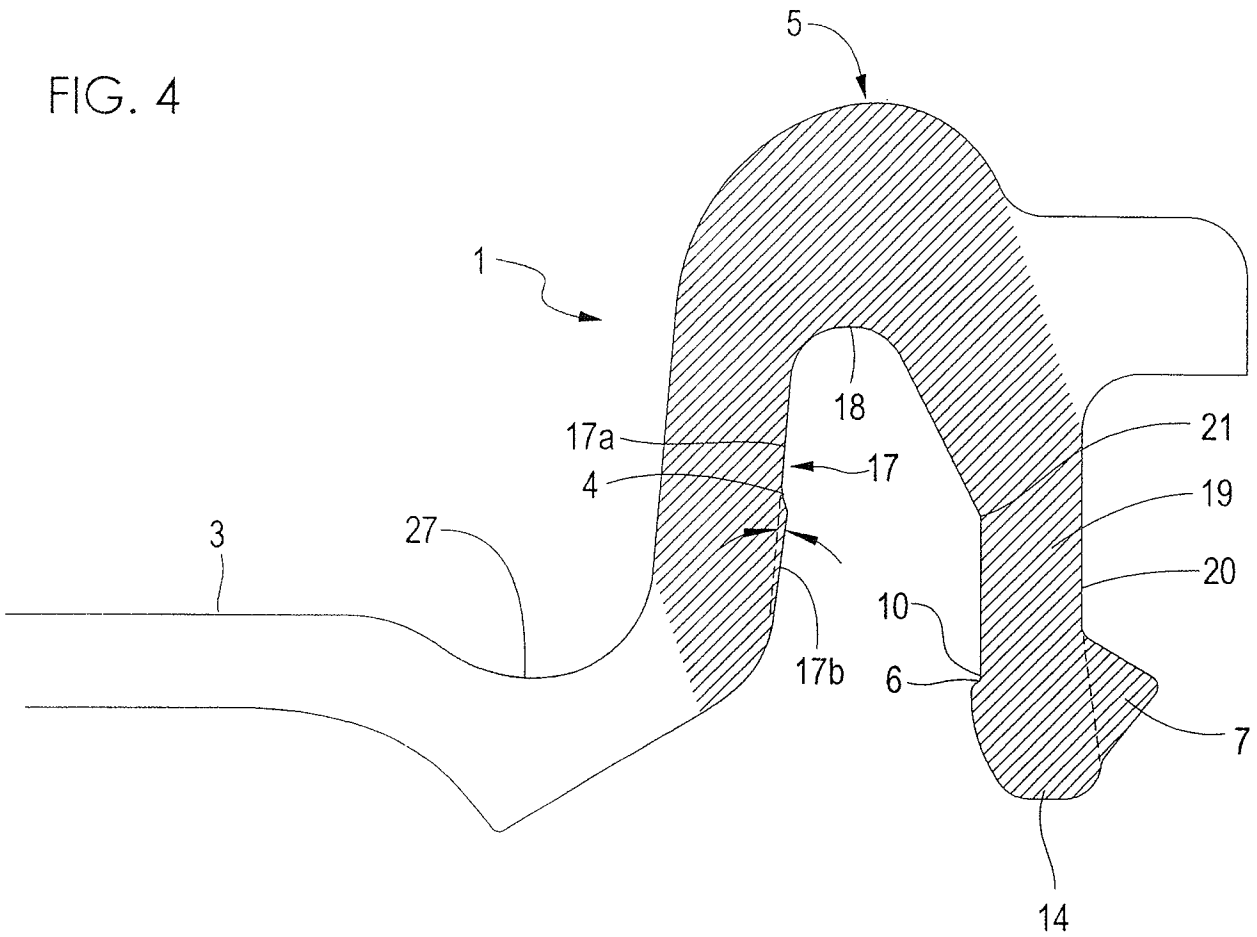
FIG. 4 is a partial sectional view of the lid in one embodiment.

Referring to FIG. 2, a cross-section of one embodiment of a portion of the lid 1 and rim 2 are shown in a pre-installed position. The lid comprises a center 3, in one embodiment a central planar section, which may be adjacent to and surrounded by a depression 27, which in turn is adjacent to the inner channel 5 on the lid's periphery. In one embodiment the inner channel 5, as shown by diagonal lines, further comprises a top 18, and a channel foot 19 between and defined by the lower regions of the second interior wall 21 and the exterior wall 20 of the inner channel 5. At its bottom the channel foot 19 may comprise a heel 14. The second interior wall 21 of the inner channel 5 may comprise a locking notch 6 which projects inwardly from the surface of the second interior wall 21. The exterior wall 20 of the outer channel 5 comprises a projection from the surface of the wall which, in one embodiment, is a ridge 7 comprising a base and two sides of equal or unequal length having an apex. The base of the ridge 7 merges with the exterior wall 20 of the outer channel and, in FIG. 4, is represented by a dotted line which is drawn from the beginning points of two unequal sides of the ridge 7. There is a projection from the first interior wall 17 of the inner channel 5 which, in one embodiment, is a cleft 4 capable of engaging the head 16 of the locking tab 23 after installation of the inner channel 5 into the outer channel 11. In one embodiment, as shown by diagonal lines the outer channel 11 comprises, starting at its periphery and moving inward, a projection from the first interior wall 22 which in one embodiment is a shoulder 9, a bottom 12, a flexible finger 13 and a locking tab 23. The flexible finger 13 and the locking tab 23 are between and defined by the exterior wall 29 and the second interior wall 30 of the outer channel 11. The exterior wall 29 and the second interior wall 30 may comprise one or more planar or curved surfaces. The lower end of the locking tab 23 transitions to the flexible finger 13 and, in one embodiment, is set at an offset angle thereto, with the head 16 of the locking tab projecting toward the center of the container from the exterior wall of the outer channel. In the embodiment depicted in the figures, the projections from the inner channel include the cleft 4, the locking notch 6 and the ridge 7, and the projections from the outer channel include the shoulder 9, the knob 15 of the locking tab and the head 16 of the locking tab. The projections from the inner and outer channel may be varied in their configurations so long as a projection from the inner channel slides past and is engaged by a projection from the outer channel upon installation—and each such complementary pair of projections when engaged in the installed position thereby creates a seal/latch combination.

Figure 3:
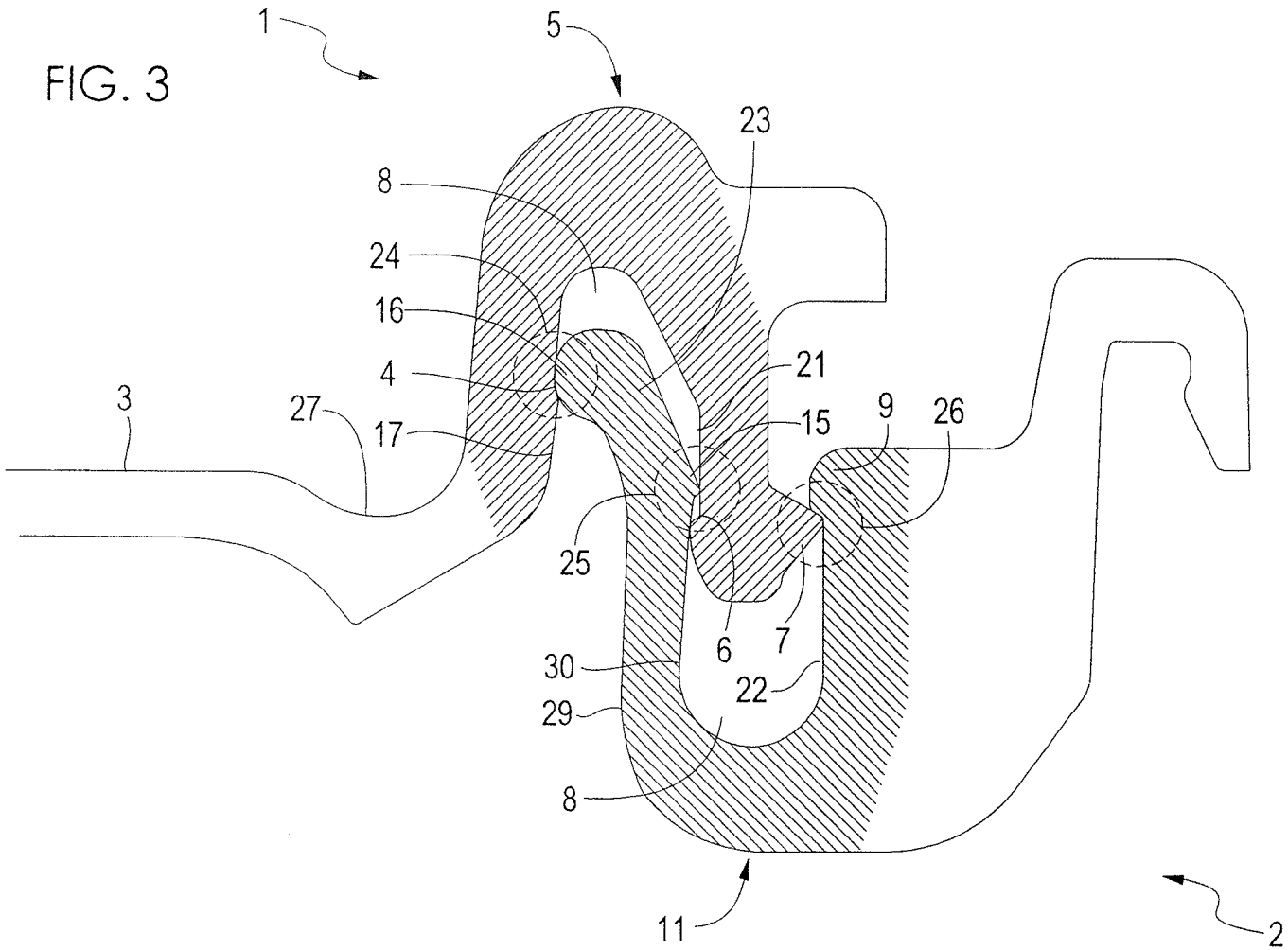
FIG. 3 is a sectional view of the rim and a portion of the lid in one embodiment in the installed position.

FIG. 3 depicts the same features as in the embodiment in FIG. 2, but in the installed position showing three seal/latch combinations from the engagement of the complementary pairs of projections from the walls of the inner channel 5 and outer channel 11. For example, in one complementary pair, the locking tab's head 16 is engaged by the cleft 4 which together form the primary seal/third latch 24. In another complementary pair, the locking tab's knob 15 is engaged by the locking notch 6 forming the second seal/second latch 25. And in another complementary pair, the ridge 7 is engaged by the shoulder 9, producing the third seal/primary latch 26. Dotted-line circles 24, 25, 26 surround each of these seal/latch combinations which, secure the lid to the rim by means of the complementary pairs of projections, and provide a liquid-tight seal. In one embodiment, upon installation of the lid, there is over-travel 8, i.e., unfilled volume between, on the one hand, the second seal/second latch 25 and the third seal/primary latch 26 and, on the other hand, the bottom 12 of the outer channel 11. In one embodiment, upon installation of the lid, there is also over-travel 8 between, on the one hand, the primary seal/third latch 24 and the second seal/second latch 25 and, on the other hand, the top of the inner channel 18. In other embodiments of the invention, there may be less or even no over-travel in that the inner channel 5 and the outer channel 11 may be sized to fit as snugly as possible.

FIG. 4 is an enlarged cross section of one embodiment of the outer portion of the lid. In this embodiment, a projection from first interior wall 17 of the inner channel 5 comprises at least two surfaces which are non-planar with respect to the other, a first surface 17*a* and a second surface 17*b*, separated by a cleft 4. Each of the first and second surfaces 17*a*, 17*b* may be planar or curved, or a combination thereof In this embodiment, the first surface 17*a* begins near the end of the curved surface which is the top 18 of the inner channel and ends at the cleft 4. In this embodiment, from the end of the first surface 17*a* on the first interior wall 17 of the inner channel 5, the cleft 4 projects into the first interior space created by the inner channel 5 and then a second surface 17*b* continues downward from the cleft 4 toward the bottom of the first interior wall 17. The cleft 4 is adapted to engage the head 16 of the locking tab and the cleft 4, in one embodiment, is created by an angle of a range between about 2-10° inclusive between the first surface 17*a* and the second surface 17*b*, as shown by the arrows pointing to the first and second surfaces 17*a*, 17*b*. The surface of the cleft 4, in another embodiment, may be a curved or planar surface which connects the end of the first surface 17*a* and the beginning of the second surface 17*b*. A dotted line between the first and second surfaces is portrayed to show the angle in one embodiment between these surfaces. In one embodiment the channel foot 19 is solid, that is, without an interior void. The second interior wall 21 of the inner channel 5, in one embodiment, comprises a projection which is the locking notch 6 which, in one embodiment, may be formed by a curve or angle which projects inwardly from a point 10 on the lower portion of the second interior wall 21 of the inner channel 5 and continues to another curve or angle on the heel 14 of the channel foot 19.

Referring again to FIG. 4, in one embodiment of the invention, the heel 14 comprises a curved surface which transitions to the exterior wall 20 of the inner channel 5, as depicted by diagonal lines, and this latter curve on the heel 14 can terminate at or near the base of the ridge 7 on the outer side of the channel foot 20, or at a surface near the bottom of the exterior wall 20 of the inner channel 5. The ridge 7 in one embodiment projects outwardly from the exterior wall 20 all around the lid 1 on its exterior wall 20 with two slopes which join at an apex or curve. The ridge 7 may also have more than two slopes. The apex of the ridge has an angle ranging preferably from about 80-90°, but a range of about 65-95° is also permissible. The ridge 7 can have two sides of equal length projecting outwardly from the exterior wall 20 of the inner channel 5. The sides of the ridge 7 projecting from the exterior wall 20 of the inner channel 5 can also be of different lengths. The apex of the ridge 7 may also be a curved surface instead of an angle.

Figure 5:
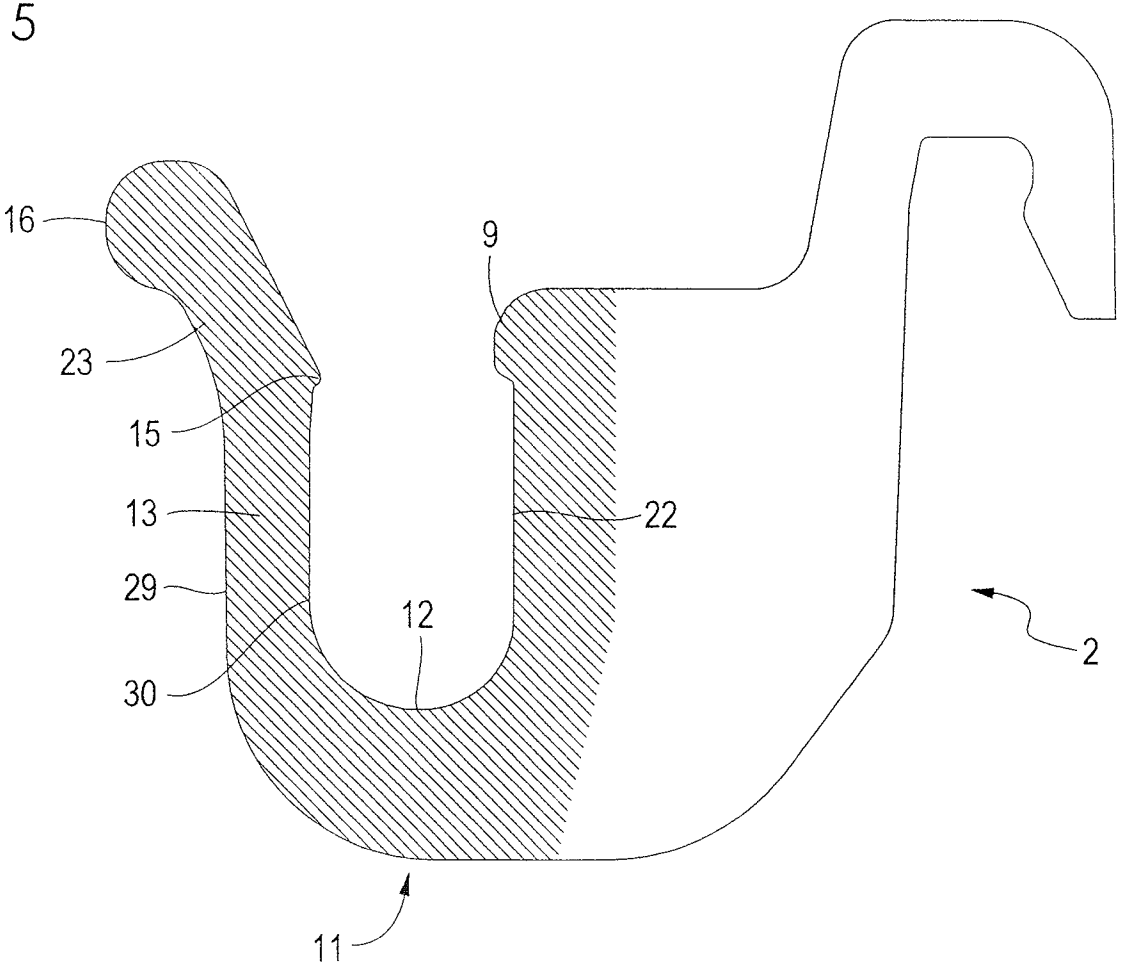
FIG. 5 is a sectional view of the rim in one embodiment.

Referring now to FIG. 5, in this embodiment of the outer channel 11, as depicted by diagonal lines, the shoulder 9 projects inwardly from near the top of the first interior wall 22, and the shoulder 9 may be a substantially planar or curved surface adjacent to the first interior wall 22, which adjoins the outer channel's bottom 12, said bottom comprising, in one embodiment, a curve or a compound curve. The bottom 12 adjoins the flexible finger 13, which in turn is adjacent to the locking tab 23. The flexible finger 13 and locking tab 23 are defined by the second interior wall 30 and the exterior wall 29.

Figure 6:
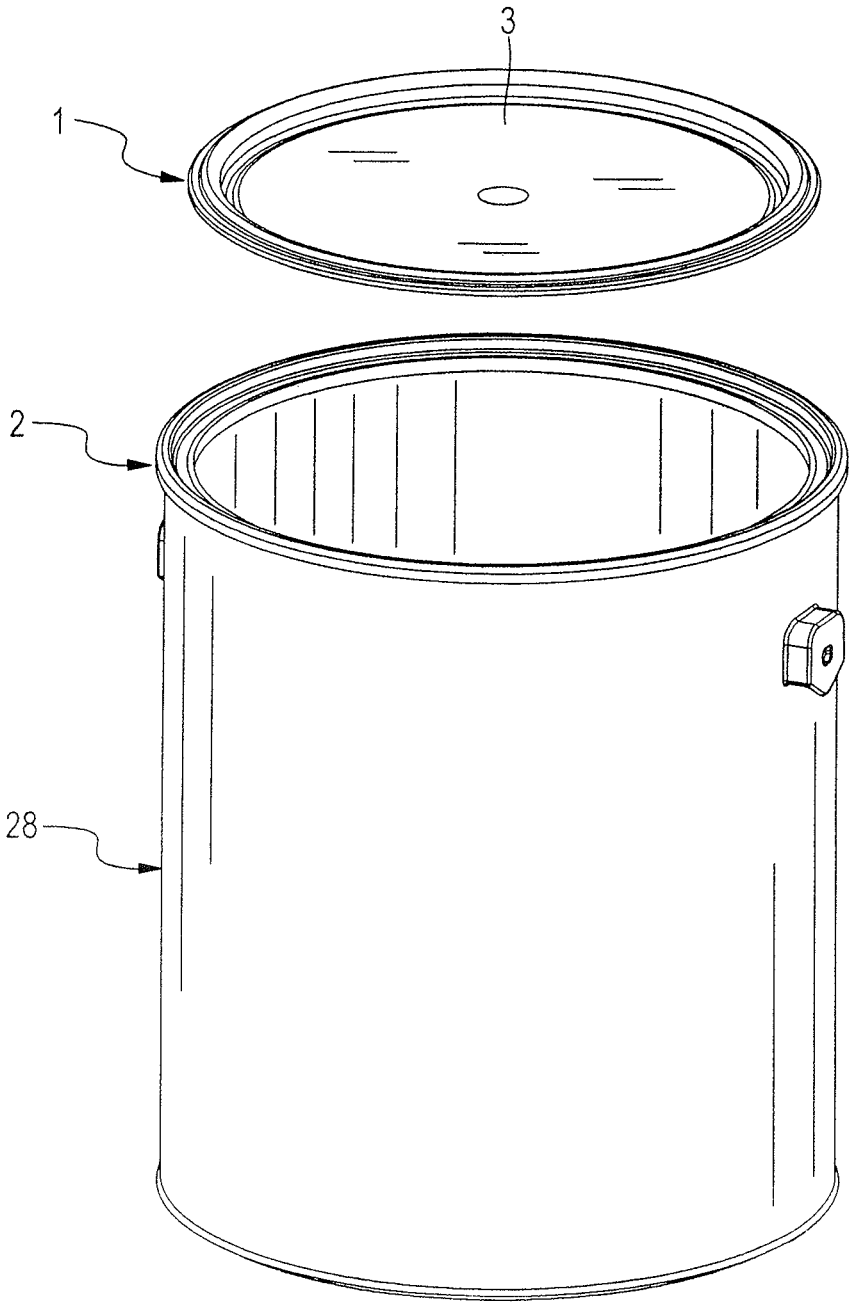
FIG. 6 is a perspective view of a cylindrical embodiment of the container and the lid in the pre-installed position.

Referring now to FIG. 6, the embodiment of the container as a cylinder 28 with the rim 2 and the lid 1 is depicted in a pre-installed position. The rim 2 may be secured tightly to the open end of the container 28 by adhesive or by spin welding.

We claim:

1. A plastic container and lid, said container comprising an open end with a rim on the top and a closed end on the bottom, said lid at its periphery comprising an inner channel facing toward the bottom and the rim comprising an outer channel slightly larger than the inner channel and facing in the same direction as the open end, the inner and outer channels each comprising a first and second interior wall and one exterior wall and further comprising a projection from each of the three walls so that, when the inner and outer channels are pressed together, each of said projections on the inner channel slides past and engages a complementary projection on the outer channel, and said complementary pairs of projections are capable of movement in relation to the other and produces three seal/latch combinations.

2. The plastic container as is claim 1, wherein the container is a cylinder.

3. The plastic container and lid is in claim 1, wherein the inner and outer channels are not damaged substantially when the projections in each of the complementary pairs slide past and engage the other.

4. The plastic container and lid as in claim 1, wherein the first and second interior walls of the inner channel define a first interior space, and the first and second interior walls of the outer channel define a second interior space.

5. The plastic container and lid as in claim 4, wherein when the lid is pressed into the rim there is an over-travel in the first and second interior spaces.

6. The plastic container and lid as in claim 1, the outer channel further comprising, from outside in and adjacent to one another end to end, a shoulder projecting from the first interior wall, a bottom, a flexible finger and a locking tab between and defined by the second interior wall and the exterior wall of the outer channel, the locking tab comprising a head projecting from the exterior wall and a knob projecting from the second interior wall of the outer channel, and the inner channel further comprising, from inside out and adjacent end to end, a first interior wall of the inner channel having a first surface and a second surface defining a cleft, a top and a channel foot and a heel between and defined by a second interior wall and exterior wall of the inner channel, the inner channel further comprising a locking notch projecting from the second interior wall and a ridge projecting from the exterior wall.

7. The plastic container and lid as in claim 6, wherein the projections from the outer channel are the shoulder on the first interior wall, the knob of the locking tab on the second interior wall, and the head of the locking tab on the exterior wall, and wherein the projections from the inner channel are the cleft on the first interior wall, the locking notch on the second interior wall, and the ridge on the exterior wall.

8. The plastic container and lid as in claim 7 wherein, when the lid is pressed into the rim, the cleft slides by and engages the head of the locking tab, the locking notch slides by and engages the knob of the locking tab, and the ridge slides by and engages the shoulder, producing a liquid-tight fit.

9. The plastic container and lid as in claim 6, further comprising the heel of the channel foot having at least one curved surface.

10. The plastic container and lid as in claim 6, further comprising the apex of the ridge of the channel foot having an angle ranging from 65-95 degrees.

11. The plastic container and lid as in claim 6, further comprising the apex of the ridge of the channel foot having a curved surface.

12. The plastic container and lid as in claim 6, wherein the locking tab is set at an offset angle to the flexible finger.

13. The plastic container and lid as in claim 6, wherein the channel foot is solid.

14. The plastic container and lid as in claim 6, wherein the shoulder further comprises a curve or a compound curve.

15. A plastic container and a lid having a pre-installed position and an installed position, said container comprising a bottom, a body and an open end with a rim having an outer channel and said lid comprising an inner channel on its periphery, said outer and inner channels each having two interior walls and an exterior wall and all of said walls having projections therefrom, each of said projections being sized to slide by and engage one of said projections from the other channel to define said installed position, so that in said installed position three complementary pairs of said projections create a liquid tight fit and there is flexibility between the rim and the lid.

16. The plastic container and lid in claim 15, wherein the first and second interior walls of the inner channel define a first interior space, and the first and second interior walls of the outer channel define a second interior space, and in the installed position there is an over-travel in the first and second interior spaces.

17. A plastic container and lid, said container comprising an open end with a rim on the top and a closed end on the bottom, said lid at its periphery comprising an inner channel facing toward the bottom and the rim comprising an outer channel slightly larger than the inner channel and facing in the same direction as the open end, the inner and outer channels each comprising a first and second interior wall and one exterior wall, each of the interior walls of the channels defining a first and a second interior space, and further comprising a projection from each of the three walls so that, when the inner and outer channels are pressed together, each of said projections on the inner channel slides past and engages a complementary projection on the outer channel, and each of said complementary pairs of projections produces three seal/latch combinations and an over-travel in the first and second interior spaces.

18. The plastic container and lid as in claim 17 wherein, after the rim and lid are pressed together, there is flexibility between the rim and the lid.

* * * * *